US006444384B2

(12) United States Patent
Kawamorita et al.

(10) Patent No.: US 6,444,384 B2
(45) Date of Patent: Sep. 3, 2002

(54) PROCESS FOR PRODUCING ELECTROPHOTOGRAPHIC PHOTOSENSITIVE MEMBER AND ELECTROPHOTOGRAPHIC PHOTOSENSITIVE MEMBER

(75) Inventors: Yoichi Kawamorita, Chigasaki; Itaru Yamazaki, Numazu; Nobumichi Miki, Shizuoka-ken; Takao Soma, Yamato; Hirotoshi Uesugi, Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/790,631

(22) Filed: Feb. 23, 2001

(30) Foreign Application Priority Data

| | | |
|---|---|---|
| Feb. 29, 2000 | (JP) | 2000-053278 |
| May 31, 2000 | (JP) | 2000-162819 |
| May 31, 2000 | (JP) | 2000-162823 |

(51) Int. Cl.[7] ..... G03G 5/05
(52) U.S. Cl. ..... 430/58.65; 430/132

(58) Field of Search ..... 430/127, 132, 430/58.05, 59.6, 58.65

(56) References Cited

U.S. PATENT DOCUMENTS

| | | | | |
|---|---|---|---|---|
| 4,931,371 A | | 6/1990 | Matsumoto et al. | 430/59 |
| 5,378,567 A | * | 1/1995 | Nozomi et al. | 430/96 |
| 6,139,999 A | * | 10/2000 | Fuller et al. | 430/58.65 |

* cited by examiner

*Primary Examiner*—John Goodrow
(74) *Attorney, Agent, or Firm*—Fitzpatrick, Cella, Harper & Scinto

(57) ABSTRACT

A process for producing an electrophotographic photosensitive member which has a charge-generating layer and a charge-transporting layer on a substrate, has steps of applying a solution containing a charge-transporting material, binder resin, dimethoxymethane, and an aromatic hydrocarbon-based solvent having a boiling point of 130° C. or higher, and drying the solution, to form the charge-transporting layer.

34 Claims, 1 Drawing Sheet

FIGURE
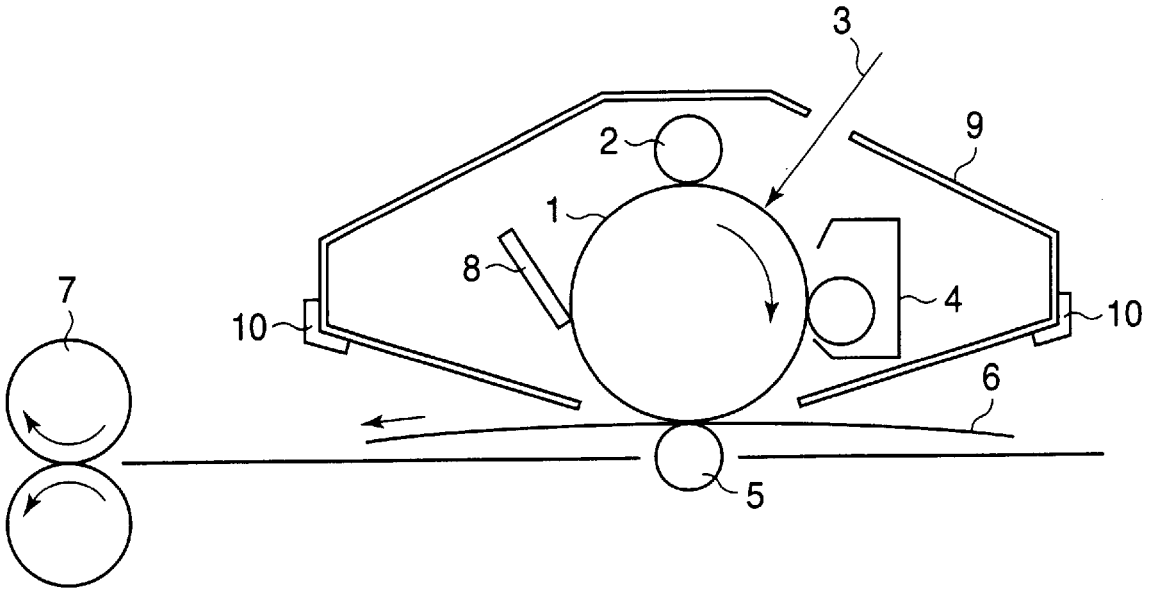

PROCESS FOR PRODUCING ELECTROPHOTOGRAPHIC PHOTOSENSITIVE MEMBER AND ELECTROPHOTOGRAPHIC PHOTOSENSITIVE MEMBER

BACKGROUND OF THE INVENTION

1. Field of the Invention

The present invention relates to a process for producing an electrophotographic photosensitive member, and an electrophotographic photosensitive member produced by the same process, more particularly to a process for producing an electrophotographic photosensitive member which uses a coating solution containing a specific solvent for a charge-transporting layer, and an electrophotographic photosensitive member produced by the same process.

2. Related Background Art

Recently, organic electrophotographic photosensitive members with photosensitive layers containing a variety of organic photoconductive compounds as major components have been extensively studied and developed. Especially, function-separated electrophotographic photosensitive members, in which charge-generating and charge-transporting functions are separately provided by different substances, have been extensively studied, because of various advantages. For example, they have wider selections of their materials for each function, and they can be produced relatively easily to have the desired functions. Many have been already commercialized.

The function-separated electrophotographic photosensitive member is generally produced by applying a coating solution in which a solid organic compound is dissolved in an organic solvent onto a substrate using an adequate method selected from a variety of coating methods and drying.

However, there are not many organic solvents which have a high dissolving power and an adequate boiling point, especially suitable for commercial production, contrary to expectations.

It is needless to say that the solvent for production of an electrophotographic photosensitive member must have a sufficient dissolving power and an adequate boiling point to give the desired product, and, at the same time, must not adversely affect the characteristics of the electrophotographic photosensitive member for which it is used. Recently, those solvents which can satisfy all of these requirements are increasingly in demand.

In the case of a laminated type electrophotographic photosensitive member in particular, with a laminated structure to have the charge-generating and charge-transporting functions separately, the charge-transporting layer (around 10 to 40 $\mu$m thick) accounts for most of the thickness of the photosensitive layer. Therefore, the solvent for the coating solution for the charge-transporting layer must satisfy various requirements, such as high dissolving power and adequate boiling point, to prevent the solution from remaining in the photosensitive layer, because the solvent may trickle down from the layer when its boiling point is excessively high, and it may damage the electrophotographic characteristics of the layer when it remains as an impurity in the layer.

Polycarbonate and polyarylate resins have been used as excellent binder resins for the charge-transporting layer.

However, the solvents for dissolving these resins to prepare the coating solutions for the charge-transporting layer are frequently halogen-containing organic solvents, e.g., methylene chloride, ethylene chloride, chloroform, monochlorobenzene, dichlorobenzene and a combination thereof. There are a number of halogen-free organic solvents, e.g., acetone, acetic acid, methylethylketone, toluene, tetrahydrofuran (THF), dioxane and cyclohexanone. However, there are few halogen-free organic solvents which satisfy all of the requirements for dissolving polycarbonate or polyarylate resin, e.g., sufficient dissolving power, adequate boiling point to prevent, e.g., trickling down while the coating layer is formed, and characteristics which make the electrophotographic photosensitive member sufficiently sensitive. The solvent is particularly required to have a sufficient dissolving power for a high-molecular-weight polycarbonate or polyarylate resin as the binder resin, when it is used for the charge-transporting layer, which has generally a thickness of 15 $\mu$m or more.

The good solvents include tetrahydrofuran as a cyclic ether having an oxygen atom in the molecule, and dioxane having two oxygen atoms in the molecule. However, tetrahydrofuran or the like is structurally unstable, needing a fairly large quantity of the stabilizer or the like which can serve as the carrier trap. Dioxane or the like, on the other hand, is highly toxic and suspected to be carcinogenic, and its use in the production line must be avoided as far as possible.

Further, the electrophotographic characteristics frequently vary greatly depending on the solvent used for the coating solution. Moreover, type of the solvent to be used is very important for productivity, and compatibility with the charge-transporting substance and binder resin. Therefore, organic solvents having better characteristics in consideration of the above are in demand.

SUMMARY OF THE INVENTION

It is an object of the present invention to provide a process which can suitably produce, under widely varying coating conditions, an electrophotographic photosensitive member showing excellent potential characteristics, durability, image characteristics and resolution for an extended period from an initial stage of image formation, and an electrophotographic photosensitive member produced by the same method.

The present invention provides a process for producing an electrophotographic photosensitive member which has a charge-generating layer and a charge-transporting layer on a substrate, comprising steps of applying a solution containing a charge-transporting material, binder resin, dimethoxymethane and an aromatic hydrocarbon-based solvent having a boiling point of 130° C. or higher, and drying the solution, to form the charge-transporting layer.

The present invention also provides an electrophotographic photosensitive member comprising a substrate, a charge-generating layer and a charge-transporting layer, wherein the charge-transporting layer is formed by applying a solution containing a charge-transporting material, binder resin, dimethoxymethane and an aromatic hydrocarbon-based solvent having a boiling point of 130° C. or higher, and drying the solution.

BRIEF DESCRIPTION OF THE DRAWING

FIGURE outlines one example of the structure of an electrophotographic device which uses the process cartridge including the electrophotographic photosensitive member of the present invention.

DETAILED DESCRIPTION OF THE PREFERRED EMBODIMENTS

The electrophotographic photosensitive member of the present invention comprises a substrate, a charge-generating layer and a charge-transporting layer, wherein the charge-transporting layer is formed by applying a solution containing a charge-transporting material, binder resin, dimethoxymethane and an aromatic hydrocarbon-based solvent having a boiling point of 130° C. or higher, and drying the solution.

The above configuration brings about the notable effects of the present invention. The mechanisms involved therein are not fully understood, but it is considered that the interface between the charge-transporting and charge-generating layers is kept in very good conditions by use of dimethoxymethane as the solvent having a relatively low boiling point and an aromatic hydrocarbon having a relatively high boiling point as the solvent evaporating more slowly. In other words, the aromatic hydrocarbon, well dissolving a binder resin (e.g., polycarbonate and polyarylate) and various materials for the charge-transporting layer, but dimethoxymethan has less solubility to the charge-transporting material as compared with aromatic hydrocarbon-based solvent, and it is possible to increase the concentration of the charge-transporting material in the charge-transporting layer at the interface side between the charge-generating layer and the charge-transporting layer rather than at the surface side of the photosensitive member. The aromatic hydrocarbon solvent with slow evaporation rate is generally difficult to freely dissolve the resins for the charge-generating layer (e.g., various types of acetal resins), although capable of swelling them. Therefore, the coating solution for the charge-transporting layer can sufficiently wet the charge-generating layer while leaving the interface between the charge-transporting and charge-generating layers, with the result that the interface of very wide area is formed between these layers. It is also considered that an aromatic organic compound interferes with charge electroconductivity or movability less than, e.g., other saturated aliphatic hydrocarbons or very polar organic compounds, even when remaining in very small quantities in the photosensitive layer.

Dimethoxymethane used for the present invention, commonly referred to as methylal, has the following structure:

$$H_3C—O—CH_2—O—CH_3$$

Methylal and binder resin (e.g., polycarbonate resin and polyarylate resin) are not completely soluble in each other. Nevertheless, it can be more compatible (i.e., more swelling) with the binder resin than other aliphatic hydrocarbons, or aliphatic solvents, e.g., alcohol, ketone, ester, carboxylic acid and ether, and also can dissolve low-molecular-weight functional materials, e.g., those for the charge-transporting layer. In particular, it has evaporation characteristics (e.g., boiling point of around 42.5° C.) which make it a suitable low-boiling solvent for the coating solution to form electrographic photosensitive members.

The aromatic hydrocarbon for the present invention boils at 130° C. or higher at 1 atm. The preferable examples include substituted ones, e.g., xylene, anisole, benzyl alcohol, phenol, cresol, monochlorobenzene and dichlorobenzene, among a number of preferable ones. In the present invention, the aromatic hydrocarbon having a boiling point of 130° C. or higher is used as the high-boiling-point solvent for the coating solution to form the electrographic photosensitive member. It is the component which does not evaporate rapidly, and secures favorable wettability with the charge-generating layer, as discussed earlier. It should be noted, however, that it may be an obstacle to improvement of wear resistance or the like, when it does not evaporate while the layer is formed to remain in the photosensitive layer as the residual solvent. Therefore, it preferably has a boiling point not exceeding 200° C. at 1 atm.

The preferable aromatic hydrocarbons for the present invention include xylene, ethylbenzene, anisole, propylbenzene, mesitylene and monochlorobenzene.

Of these, xylene (including its structural isomers), ethylbenzene and monochlorobenzene, having a boiling point of around 130 to 145° C., are more preferable, because they are expected to remain in the photosensitive layer to only a limited extent. In view of dehalogenation, xylene and ethylbenzene are more preferable, and in view of the solbility of the binder resin, monochlorobenzene is also more preferable.

In the present invention, total weight of dimethoxymethan and aromatic hydrocarbon-based solvent in the solution is preferably 70 to 90% by weight, based on the total weight of the solution. If the total weight is beyond this range, the solution with sufficient uniformal and appropriate viscosity is hardly obtained.

The mixing ratio of dimethoxymethane/aromatic hydrocarbon-based solvent for the present invention is set at a desired level in consideration of quantity of the solvent required to dissolve the solid component, easiness for whitening, and prevention of trickling down from the thick layer. It is however preferably in a range from 5/95 to 60/40 by weight, more preferably from 10/90 to 50/50.

The charge-transporting layer is formed by applying a solution mainly composed of a charge-transporting material and binder resin dissolved in the above-mentioned solvent, and drying the solution. The charge-transporting materials useful for the present invention include low-molecular-weight compounds, e.g., a triarylamine-based compound, hydrazone-based compound, stilbene-based compound, pyrazoline-based compound, oxazole-based compound, triarylmethane-based compound and thiazole-based compound. The binder resins useful for the present invention include polycarbonate, polyarylate, polyacrylate, polyester, polystyrene, styrene-acrylonitrile copolymer, polymethacrylate ester and styrene-methacrylate ester copolymer. It is preferable that the charge-transporting material is combined with in weight ratio 0.5 to 2 times, particularly 0.7 to 1 time larger quantity of the binder resin. The charge-transporting layer is preferably 5 to 40 $\mu$m thick, more preferably 15 to 30 $\mu$m thick.

The charge-transporting materials particularly useful for the present invention, viewed from compatibility with the above-mentioned solvent, include the following compounds:

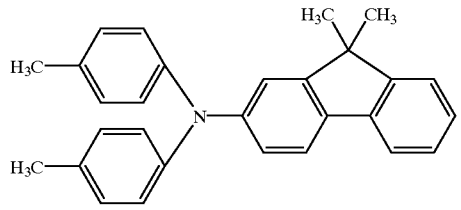

-continued

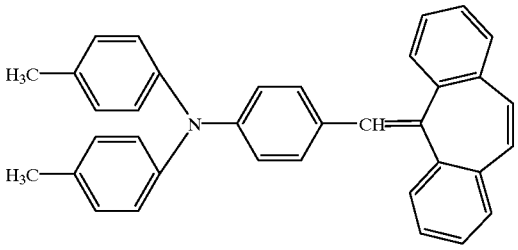

Similarly, the binder resins particularly useful for the present invention, viewed from compatibility with the solvent and charge-transporting material, include polycarbonate resin and polyarylate resin. Some of more preferable structural units of polycarbonate resin and polyarylate resin are shown below. These structural units can be used as copolymer, if necessary. In the formulae, n and m represent degrees of polymerization (molar ratio). Of these, as a structural unit of polycarbonate resin, (1-2), (1-3) and (1-4), and (1-3) are more preferably, and as a structural unit of polyarylate resin, (2-2) and (2-4) are more preferably.

(1-1)

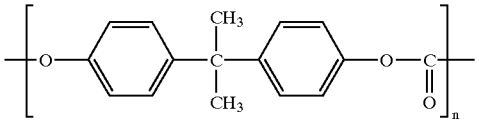

(1-2)

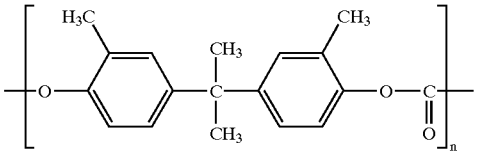

(1-3)

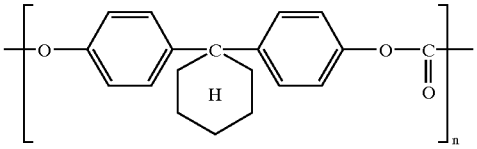

(1-4)

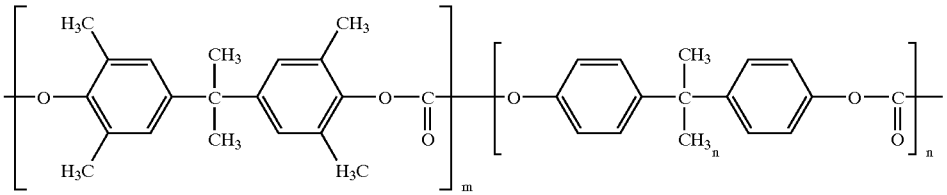

(2-1)

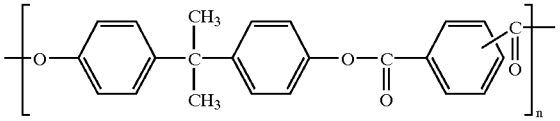

(2-2)

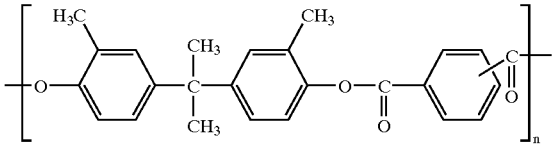

(2-3)

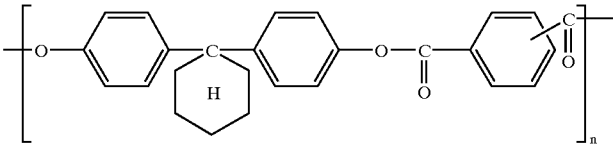

(2-4)

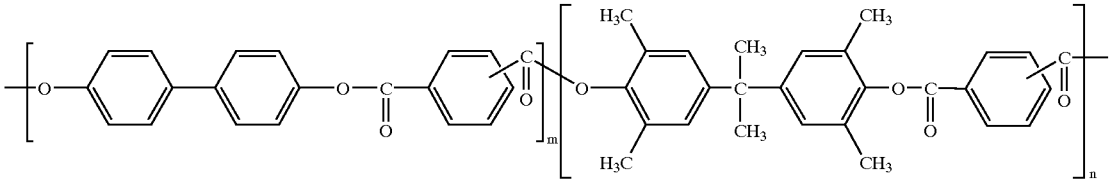

It is preferable to use an antioxidant (AO agent) for the present invention, to enhance storage stability of methylal. The antioxidants are not limited for their chemical structures, so long as it is not harmful to the electrophotographic characteristics. Some examples of preferable compounds are those having a hindered amine and/or hindered phenol structural units, organophosphorus-based compounds, organosulfur-based compounds, hydroquinone-based compounds and phenylamine-based compounds.

(1) Examples of compounds having a hindered phenol structural unit:

(3-1)

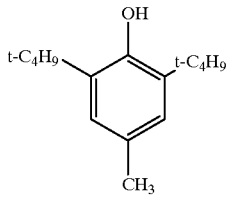

(3-2)

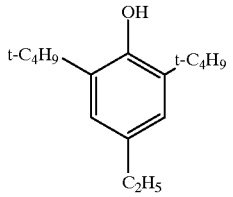

(3-3)

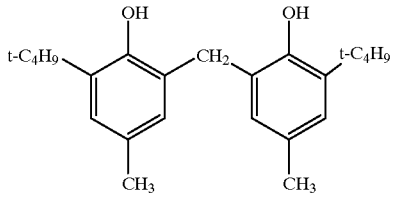

(2) Examples of compounds having a hindered amine structural unit:

(3-4)

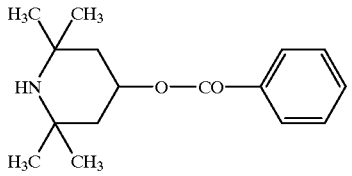

(3-5)

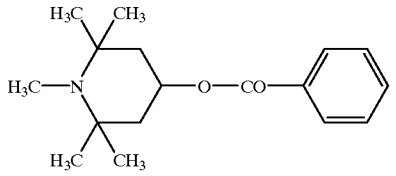

(3) Examples of organophosphorus-based compounds:

(3-6)

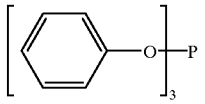

(3-7)

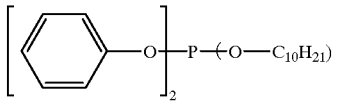

(4) Examples of organosulfur-based compounds:

$S(C_2H_4COOC_{12}H_{25})_2$ (3-8)

$S(C_2H_4COOC_{14}H_{29})_2$ (3-9)

(5) Hydroquinone-based compound (3-10) and a derivative thereof:

(3-10)

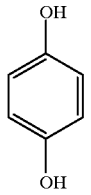

Of these compounds, more preferable ones are those having a hindered phenol structural unit in the molecule, for stability of the coating solution composition, and repeating characteristics and potential stability of the electrophotographic photosensitive member.

The amount of an antioxidant is preferably 10 to 500 ppm based on methylal. It is preferable to keep the antioxidant content as low as possible for desired liquid storage period; the coating solution ages rapidly when it is too low, whereas the electrophotographic characteristics will be deteriorated (e.g., decreased sensitivity and increased residual potential) when it is too high.

The electrophotographic photosensitive member has the charge-generating layer and the charge-transporting layer on the substrate, but preferably has the charge-transporting layer as the surface layer, for manifesting the functions more efficiently.

The substrate is not limited, so long as it is electroconductive. Some of the examples include metals, e.g., aluminum and stainless steel, and metals, paper and plastics coated with an electroconductive layer. It has a shape of sheet, cylinder or the like.

The present invention may be coated with an electroconductive layer to cover scratches on the substrate. The electroconductive layer may be of powdered electroconductive material, e.g., carbon black or metal, dispersed in the binder resin. It is preferably 5 to 40 $\mu$m thick, more preferably 10 to 30 $\mu$m thick.

The present invention may be provided with an intermediate layer having adhesive and barrier functions on the substrate or between the electroconductive and photosensitive layers on the substrate. The materials useful for the intermediate layer include polyamide, polyvinyl alcohol, polyethylene oxide, ethyl cellulose, casein, polyurethane and polyether urethane. It is applied after being dissolved in an adequate solvent. The intermediate layer is preferably 0.05 to 5 μm thick, more preferably 0.3 to 1 μm thick.

The charge-generating layer is formed by applying a coating solution containing a charge-generating material and binder resin dissolved in a solvent, and drying the solution. The mixture of the charge-generating material, binder resin and solvent is treated by, e.g., a homogenizer, ultrasonic disperser, ball mill, vibrational ball mill, sand mill, attritor, roller mill and liquid-impingement type high-speed disperser, to well disperse the charge-generating material and binder resin in the solvent. The charge-generating materials useful for the present invention include dyes, e.g., those based on pyrrylium and thiapyrrylium; and pigments, e.g., those based on phthalocyanine, anthanthrone, dibenzpyrenequinone, trisazo, cyanine, disazo, monoazo, indigo, quinacridon, and asymmetric quinocyanine. The typical binder resins useful for the present invention include polyester, polyacrylic, polyvinyl carbazole, phenoxy, polycarbonate, polystyrene, polyvinyl acetate, polysulfone, polyarylate, vinilidene chloride, polyvinyl benzal and polybutyral. The ratio of charge-generating material to binder resin is 1/0.1 to 1/10 by weight, preferably 1/1 to 3/1. The charge-generating layer is preferably 5 μm thick or less, more preferably 0.1 to 2 μm.

FIGURE illustrates one example of contact charging type electrophotographic apparatus, as a transfer type copier or printer. It is a cartridge type, with an electrophotographic photosensitive member 1, charging roller 2, developing device 4 and cleaning blade 8 assembled in a process cartridge frame 9.

The electrophotographic photosensitive member 1 is of drum type, driven to rotate at a given speed (process speed) in the arrowed direction.

The charging roller 2 is a contact-charging member as the charging means. This charging roller 2 rotates, driven by the rotating electrophotographic photosensitive member 1 in contact with the charging roller 2. A DC voltage, which may be superimposed with AC voltage, from a bias power source (not shown) is applied to the charging roller 2, to charge the peripheral surface of the electrophotographic photosensitive member 1 at a given polarity/potential. The charged surface of the electrophotographic photosensitive member 1 is irradiated with exposure light 3 carrying image information by exposure means (not shown), e.g., laser beam scanner, to form the electrostatic latent image corresponding to the above information on the electrophotographic photosensitive member 1.

The electrostatic latent image thus formed becomes sensible, by normal or reverse development, as the transferable particle image (toner image) with the charged particles (toner) held in the developing device 4.

The toner image is transferred to the transfer medium 6, supplied between the electrophotographic photosensitive member 1 and transferring roller 5 coming into contact with each other, while a bias voltage, with a polarity reverse to that of the charge on the toner, is applied to the transferring roller 5 from a bias power source (not shown).

The transfer medium 6, onto which the toner image is transferred, is separated from the electrophotographic photosensitive member 1, and transported to the fixing roller 7, by which the toner image is fixation-treated.

The electrophotographic photosensitive member 1, after the toner image is transferred, is cleaned by the cleaning blade 8 to remove the deposits, e.g., residual toner, to complete the total process.

The present invention is described more concretely by EXAMPLES, where "part(s)" means part(s) by weight.

EXAMPLE 1

The photosensitive member was prepared under the conditions of 23° C., 60% RH and 1 atm. First, an aluminum cylinder with 30 mm in diameter and 358 mm hight, as the support was dip-coated with the coating solution of the following composition, which was thermally set at 140° C. for 30 minutes, to form a 15 μm thick electroconductive layer.

| | |
|---|---|
| Electroconductive pigment: $SnO_2$-coated barium sulfate | 10 parts |
| Resistance-adjusting pigment: Titanium oxide | 2 parts |
| Binder resin: Phenol resin | 6 parts |
| Leveling agent: Silicone oil | 0.001 parts |
| Solvent: Methanol/methoxypropanol (0.2/0.8) | 20 parts |

The electroconductive layer thus prepared was dip-coated with a solution of 3 parts of N-methoxymethylated nylon and 3 parts of copolymerized nylon dissolved in a mixed solvent of 65 parts of methanol and 30 parts of n-butanol, to form a 0.5 μm thick intermediate layer.

Next, 4 parts of oxytitanium phthalocyanine (TiOPc), having strong peaks at 9.0°, 14.2°, 23.9° and 27.1° at a Bragg angle 2θ±0.2° in X-ray diffraction patterns prepared by diffractometry with CuKα ray and 2 parts of polyvinyl butyral (Sekisui Chemical Co., Ltd., S-LEC BM2) were dispersed in 60 parts of cyclohexanone by a sand mill with glass beads (diameter: 1 mm) for 4 hours, to which 100 parts of ethyl acetate was added, to prepare the dispersion solution for the charge-generating layer. The 0.2 μm thick charge-generating layer was formed with the solution by dip coating.

Next, 10 parts of the charge-transporting material, shown by the following formula (4), and 10 parts of polycarbonate resin (Mitsubishi Engineering Plastics, Z-400 (Trade name)) were dispersed in 60 parts of a mixed solvent (20 parts of methylal and 60 parts of ethylbenzene having a boiling point of 136.2° C.), to prepare the coating solution for the charge-transporting layer.

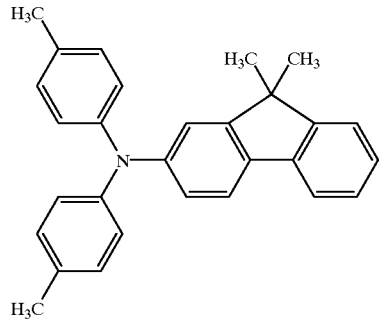

(4)

This coating solution was applied to the charge-generating layer by dip coating at a constant coating rate, and dried at 140° C. for 30 minutes, to form the charge-transporting layer (thickness: 28 μm in the vicinity of the center). The dried charge-transporting layer was observed by an optical microscope, and rated for whitening by ×: whitened when the sample had a number of fine bubbles, and ○: not whitened when the sample showed no fine bubbles. The results are given in Table 2.

Next, difference in thickness between the positions 180 mm and 20 mm from the upper end (uncoated side) of the charge-transporting layer, where the former position was near the center of the electrophotographic photosensitive member. The layer was rated for trickling-down of the solution by ○: difference: less than 5.5 μm, Δ: difference: 5.5 μm, and ×: difference: more than 5.5 μm. The results are given in Table 2.

Next, evaluation of the charge-transporting layer using an electrophotographic apparatus is described.

The apparatus used was Canon LBP-930 (modified to have a process speed doubled to 212 mm/second from the initial speed of 106 mm/second, a filter in the laser beam irradiation section, and light volume halved from the normal level, electric amount of AC component of primary charging and frequency being 2 times) equipped with its process cartridge.

The electrophotographic photosensitive member prepared was set in the above apparatus, and tested for letter paper durability under the conditions of normal temperature and normal humidity (around 23° C. and 60% RH) in an intermittent mode where the sequence was stopped for every print. The light area voltage (Vl) was measured in the initial stage and after 2000 sheets were printed at a printing rate of 2%. The results are given in Table 2. The member was more sensitive when its absolute Vl level was lower, because dark area voltage was set constant at −675 V.

EXAMPLES 2 TO 13

The electrophotographic photosensitive members were prepared in the same manner as in EXAMPLE 1, except that different solvent compositions (No. 2 to 13 given in Table 1) were used for the charge-transporting layers, BHT (2,6-di-tert-butyl-4-methylphenol) was used or not used as the antioxidant, the charge-transporting layers were dried at 120° C. for 60 minutes, and layer thickness was set at 26 μm. They were tested in the same manner as in EXAMPLE 1 for layer whitening, trickling-down of the solutions, and light area voltage (Vl) in the initial stage and after 2000 sheets were printed. The results are given in Table 2.

TABLE 1

| EXAMPLES | Solvent 1 | Solvent 2 | Antioxidant (ratio to BHT or methylal) |
|---|---|---|---|
| 1 | 20 parts of methylal | 60 parts of ethylbenzene (BP: 136.2° C.) | No |
| 2 | 20 parts of methylal | 60 parts of p-xylene (BP: 138.3° C.) | No |
| 3 | 20 parts of methylal | 60 parts of monochlorobenzene (BP: 131.7° C.) | No |
| 4 | 20 parts of methylal | 60 parts of anisole (BP: 153.8° C.) | No |
| 5 | 20 parts of methylal | 60 parts of ethylbenzene | 30 ppm |
| 6 | 20 parts of methylal | 60 parts of p-xylene | 70 ppm |
| 7 | 20 parts of methylal | 60 parts of anisole | 100 ppm |
| 8 | 45 parts of methylal | 35 parts of p-xylene | No |
| 9 | 40 parts of methylal | 40 parts of p-xylene | No |
| 10 | 10 parts of methylal | 70 parts of ethylbenzene | No |
| 11 | 5 parts of methylal | 75 parts of ethylbenzene | No |
| 12 | 20 parts of methylal | 60 parts of benzyl alcohol (BP: 205.8° C.) | No |
| 13 | 20 parts of methylal | 60 parts of m-cresol (BP: 202.2° C.) | No |

TABLE 2

| EXAMPLES | Whitening | Solution trickling-down | Initial light area voltage (V) | Light area voltage (V) after durability test |
|---|---|---|---|---|
| 1 | ○ | ○ | −180 | −170 |
| 2 | ○ | ○ | −175 | −160 |
| 3 | ○ | ○ | −180 | −170 |
| 4 | ○ | ○ | −190 | −180 |
| 5 | ○ | ○ | −185 | −180 |
| 6 | ○ | ○ | −190 | −170 |
| 7 | ○ | ○ | −195 | −180 |
| 8 | ○ | ○ | −190 | −195 |
| 9 | ○ | ○ | −185 | −170 |
| 10 | ○ | ○ | −180 | −170 |
| 11 | ○ | Δ | −190 | −185 |
| 12 | ○ | ○ | −195 | −185 |
| 13 | ○ | ○ | −195 | −195 |

COMPARATIVE EXAMPLES 1 TO 8

The electrophotographic photosensitive members were prepared in the same manner as in EXAMPLE 1, except that different solvent compositions (No. 1 to 8 given in Table 3) were used for the charge-transporting layers, the charge-transporting layers were dried at 120° C. for 60 minutes, and layer thickness was set at 26 μm. They were tested in the same manner as in EXAMPLE 1 for layer whitening, trickling-down of the solutions, and light area voltage (Vl) in the initial stage and after 2000 sheets were printed. The results are given in Table 4.

TABLE 3

| COMPARATIVE EXAMPLES | Solvent 1 | Solvent 2 | Antioxidant (ratio to BHT or methylal) |
|---|---|---|---|
| 1 | 20 parts of methylal | 60 parts of n-butanol (BP: 117.7° C.) | No |
| 2 | 20 parts of methylal | 60 parts of di-n-propylketone (BP: 143.7° C.) | No |
| 3 | 20 parts of methylal | 60 parts of cyclohexanone (BP: 155.7° C.) | No |
| 4 | 20 parts of methylal | 60 parts of acetylacetone (BP: 140.4° C.) | No |
| 5 | No | 80 parts of p-xylene | No |
| 6 | 80 parts of methylal | No | No |
| 7 | 20 parts of dichloromethane (BP: 39.8° C.) | 60 parts of chlorobenzene | No |
| 8 | 20 parts of methylal | 60 parts of toluene (BP: 110.6° C.) | 100 ppm |

TABLE 4

| COMPARATIVE EXAMPLES | Whitening | Solution trickling-down | Initial light area voltage (V) | Light area voltage (V) after durability test |
|---|---|---|---|---|
| 1 | The solid remained (residual insolubles), leading to suspension of the coating. | | | |
| 2 | The solid remained (residual insolubles), leading to suspension of the coating. | | | |
| 3 | ○ | ○ | −260 | −260 |
| 4 | ○ | ○ | −265 | −260 |
| 5 | ○ | x | −215 | −210 |
| 6 | The solid remained (residual insolubles), leading to suspension of the coating. | | | |
| 7 | ○ | ○ | −185 | −140 |
| 8 | ○ | ○ | −220 | −215 |

EXAMPLES 14 TO 16

The electrophotographic photosensitive members were prepared in the same manner as in EXAMPLE 1, except that different solvent compositions (No. 14 to 16 given in Table 5) were used for the charge-transporting layers, polyarylate (weight-average molecular weight Mw: 100,000) shown by the above-mentioned formula (2-2) was used as the binder resin for the charge-transporting layer, the charge-transporting layers were dried at 120° C. for 60 minutes, and layer thickness was set at 26 μm. They were tested in the same manner as in EXAMPLE 1 for layer whitening, trickling-down of the solutions, and light area voltage (Vl) in the initial stage and after 2000 sheets were printed. The results are given in Table 6.

EXAMPLE 17

The electrophotographic photosensitive member was prepared in the same manner as in EXAMPLE 1, except that a different solvent composition (No. 17 given in Table 5) was used for the charge-transporting layer, a 1:1 (weight ratio) mixture of the above-mentioned polycarbonate resin Z-400 and the polyarylate resin (weight-average molecular weight Mw: 100,000) shown by the above-mentioned formula (2-2) was used as the binder resin for the charge-transporting layer, the charge-transporting layer was dried at 120° C. for 60 minutes, and layer thickness was set at 26 μm. It was tested in the same manner as in EXAMPLE 1 for layer whitening, trickling-down of the solution, and light area voltage (Vl) in the initial stage and after 2000 sheets were printed. The results are given in Table 6.

EXAMPLE 18

The electrophotographic photosensitive member was prepared in the same manner as in EXAMPLE 1, except that a different solvent composition (No. 18 given in Table 5) was used for the charge-transporting layer, polymethyl methacrylate (weight-average molecular weight Mw: 100,000) was used as the binder resin for the charge-transporting layer, the charge-transporting layer was dried at 120° C. for 60 minutes, and layer thickness was set at 26 μm. It was tested in the same manner as in EXAMPLE 1 for layer whitening, trickling-down of the solution, and light area voltage (Vl) in the initial stage and after 2000 sheets were printed. The results are given in Table 6.

TABLE 5

| EXAMPLES | Solvent 1 | Solvent 2 | Antioxidant (ratio to BHT or methylal) |
|---|---|---|---|
| 14 | 20 parts of methylal | 60 parts of ethylbenzene | No |
| 15 | 20 parts of methylal | 60 parts of p-xylene | No |
| 16 | 20 parts of methylal | 60 parts of o-xylene | No |
| 17 | 20 parts of methylal | 60 parts of ethylbenzene | No |
| 18 | 20 parts of methylal | 60 parts of anisole | 50 ppm |

TABLE 6

| EXAMPLES | Whitening | Solution trickling-down | Initial light area voltage (V) | Light area voltage (V) after durability test |
|---|---|---|---|---|
| 14 | ○ | ○ | −185 | −175 |
| 15 | ○ | ○ | −180 | −165 |
| 16 | ○ | ○ | −185 | −175 |
| 17 | ○ | ○ | −185 | −165 |
| 18 | ○ | ○ | −200 | −195 |

The coating solutions for the charge-transporting layers prepared in EXAMPLES 1 to 7 were observed for their outer appearances 12 months after they were prepared. Those for EXAMPLES 5 to 7 containing the antioxidant showed no change, whereas those for EXAMPLES 1 to 4 free of the antioxidant slightly increased in yellowish color, suggesting deterioration of the methylal.

EXAMPLE 19

The electrophotographic photosensitive member was produced in the same manner as in Example 14 except that 10 parts by weight of the compound represented by the following formula (5) was used as a charge-transporting material, and then layer whitening, trickling-down of the solution and light area voltage (Vl) before and after the durability test were evaluated and measured. The results obtained are shown in Table 7.

(5)

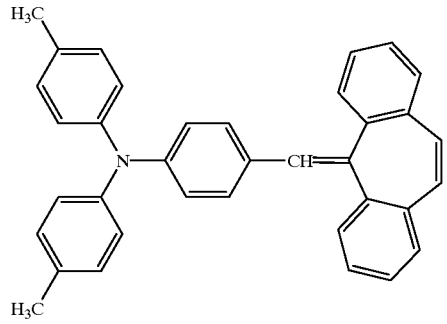

EXAMPLE 20

The electrophotographic photosensitive member was produced in the same manner as in Example 15 except that as a charge transporting material each of the compounds represented by the above formulae (4) and (5) were used in an amount of 5 parts by weight (Total weight: 10 parts by weight), and then layer whitening, trickling-down of the solution and light area voltage (Vl) before and after the durability test were evaluated and measured. The results obtained are shown in Table 7.

EXAMPLE 21

The electrophotographic photosensitive member was produced in the same manner as in Example 16 except that as a charge transporting material the compounds represented by the above formulas (4) and (5) were used in an amount of 8 parts by weight and 2 parts by weight, respectively (Total weight: 10 parts by weight) and the components of the solvent were changed to 20 parts by weight of methylal and 60 parts by weight of monochlorobenzene, and then layer whitening, trickling-down of the solution and light area voltage (Vl) before and after the durability test were evaluated and measured. The results obtained are shown in Table 7.

TABLE 7

| EXAMPLES | Whitening | Solution trickling-down | Initial light area voltage (V) | Light area voltage (V) after durability test |
|---|---|---|---|---|
| 19 | ○ | ○ | −185 | −175 |
| 20 | ○ | ○ | −180 | −165 |
| 21 | ○ | ○ | −185 | −180 |

What is claimed is:

1. A process for producing an electrophotographic photosensitive member which has a charge-generating layer and a charge-transporting layer on a substrate, comprising steps of applying a solution containing a charge-transporting material, binder resin, dimethoxymethane, and an aromatic hydrocarbon-based solvent having a boiling point of 130° C. or higher, and drying the solution, to form the charge-transporting layer.

2. The process according to claim 1, wherein said aromatic hydrocarbon-based solvent has a boiling point of 130° C. or higher but 200° C. or lower.

3. The process according to claim 1, wherein a weight ratio of said dimethoxymethane to said aromatic hydrocarbon-based solvent is in a range from 5:95 to 60:40.

4. The process according to claim 1, wherein said aromatic hydrocarbon-based solvent is selected from the group consisting of xylene, ethylbenzene, anisole, propylbenzene, mesitylene and monochlorobenzene.

5. The process according to claim 4, wherein said aromatic hydrocarbon-based solvent is selected from the group consisting of xylene, ethylbenzene, and monochlorobenzene.

6. The process according to claim 5, wherein said aromatic hydrocarbon-based solvent is xylene or ethylbenzene.

7. The process according to claim 5, wherein said aromatic hydrocarbon-based solvent is monochlorobenzene.

8. The process according to claim 1; wherein said charge-transporting material is selected from the group consisting of the compounds shown by the following formulae:

(4)

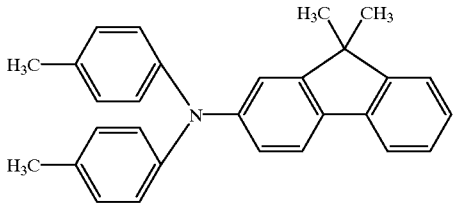

(5)

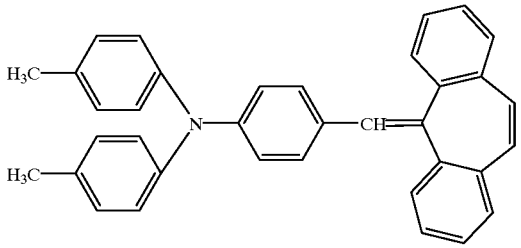

9. The process according to claim 1, wherein said binder resin is one of polycarbonate resin and polyarylate resin.

10. The process according to claim 9, wherein said binder resin is polycarbonate resin.

11. The process according to claim 9, wherein said binder resin is polyarylate resin.

12. The process according to claim 10, wherein said polycarbonate resin has a structural unit selected from those shown by the following formulae:

(1-2)

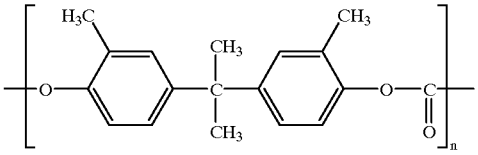

(1-3)

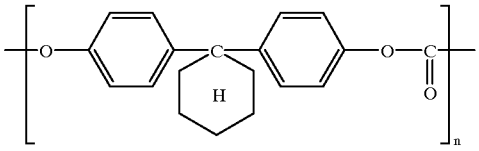

(1-4)

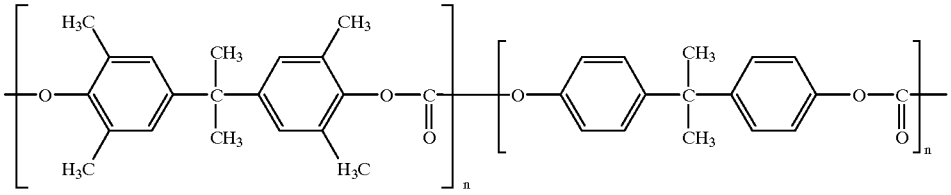

13. The process according to claim 11, wherein said polyarylate resin has a structural unit selected from those shown by the following formulae:

(2-2)

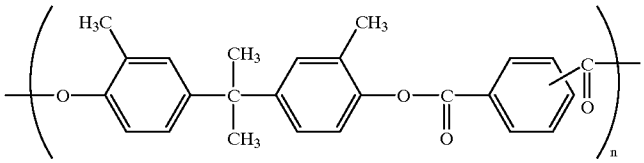

(2-4)

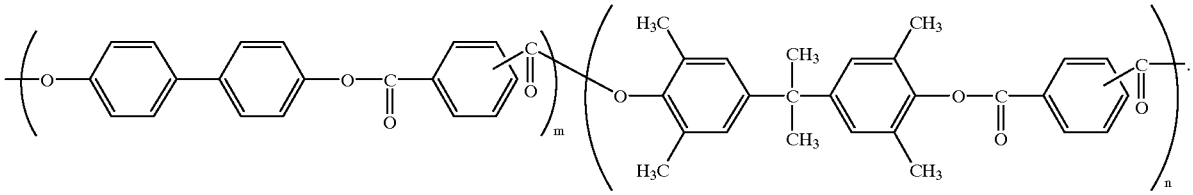

14. The process according to claim 1, wherein said solution further contains an antioxidant.

15. The process according to claim 1, wherein said antioxidant has a hindered phenol structure.

16. The process according to claim 1, wherein said antioxidant is incorporated at 10 to 500 ppm based on dimethoxymethane.

17. The process according to claim 1, wherein said electrophotographic photosensitive member has said substrate, charge-generating layer, and charge-transporting layer in this order.

18. An electrophotographic photosensitive member comprising a substrate, a charge-generating layer and a charge-transporting layer, wherein the charge-transporting layer is formed by applying a solution containing a charge-transporting material, binder resin, dimethoxymethane, and an aromatic hydrocarbon-based solvent having a boiling point of 130° C. or higher, and drying the solution.

19. The electrophotographic photosensitive member according to claim 18, wherein said aromatic hydrocarbon-based solvent has a boiling point of 130° C. or higher but 200° C. or lower.

20. The electrophotographic photosensitive member according to claim 18, wherein a weight ratio of said dimethoxymethane to said aromatic hydrocarbon-based solvent is in a range from 5:95 to 60:40.

21. The electrophotographic photosensitive member according to claim 18, wherein said aromatic hydrocarbon-based solvent is selected from the group consisting of xylene, ethylbenzene, anisole, propylbenzene, mesitylene, and monochlorobenzene.

22. The electrophotographic photosensitive member according to claim 21, wherein said aromatic hydrocarbon-based solvent is selected from the group consisting of xylene, ethylbenzene, and monochlorobenzene.

23. The electrophotographic photosensitive member according to claim 22, wherein said aromatic hydrocarbon-based solvent is xylene or ethylbenzene.

24. The electrophotographic photosensitive member according to claim 22, wherein said aromatic hydrocarbon-based solvent is monochlorobenzene.

25. The electrophotographic photosensitive member according to claim 18, wherein said charge-transporting material is selected from the group consisting of the compounds shown by the following formulae:

(4)

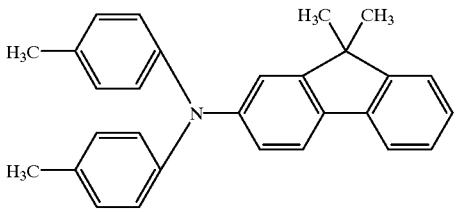

(5)

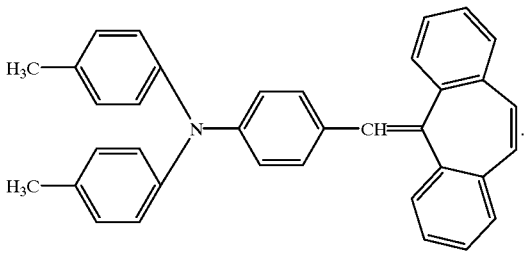

26. The electrophotographic photosensitive member according to claim 18, wherein said binder resin is one of polycarbonate resin and polyarylate resin.

27. The electrophotographic photosensitive member according to claim 26, wherein said binder resin is polycarbonate resin.

28. The electrophotographic photosensitive member according to claim 26, wherein said binder resin is polyarylate resin.

29. The electrophotographic photosensitive member according to claim 27, wherein said polycarbonate has the structural unit selected from those shown by the following formulae:

(1-2)

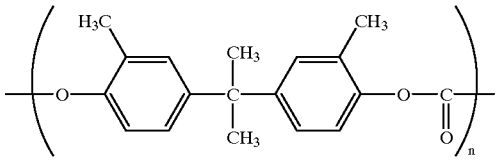

(1-3)

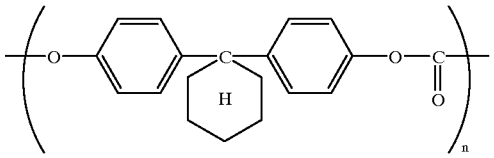

(1-4)

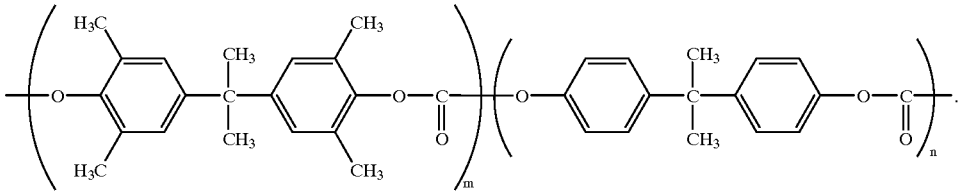

30. The electrophotographic photosensitive member according to claim 28, wherein said polyarylate resin has the structural unit selected from those shown by the following formulae:

(2-2)

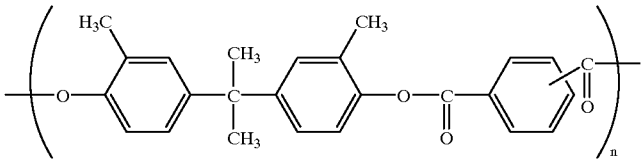

(2-4)

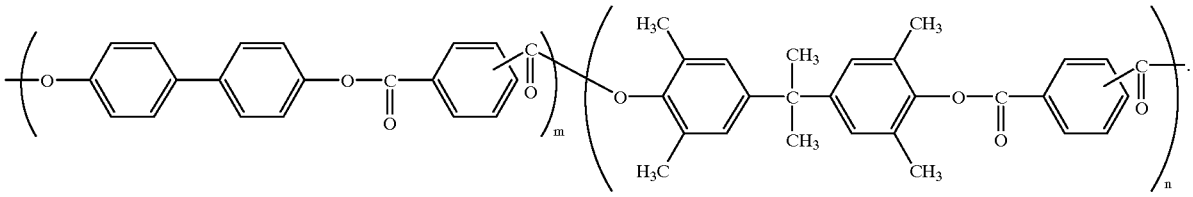

31. The electrophotographic photosensitive member according to claim 18, wherein said solution further contains an antioxidant.

32. The electrophotographic photosensitive member according to claim 18, wherein said antioxidant has a hindered phenol structure.

33. The electrophotographic photosensitive member according to claim 18, wherein said antioxidant is incorporated at 10 to 500 ppm based on dimethoxymethane.

34. The electrophotographic photosensitive member according to claim 18, wherein said electrophotographic photosensitive member has said substrate, charge-generating layer, and charge-transporting layer in this order.

* * * * *

UNITED STATES PATENT AND TRADEMARK OFFICE

CERTIFICATE OF CORRECTION

PATENT NO. : 6,444,384 B2
DATED : September 3, 2002
INVENTOR(S) : Kawamorita et al.

It is certified that error appears in the above-identified patent and that said Letters Patent is hereby corrected as shown below:

Columns 15-16,
Formula (1-4)

(1-4)

"

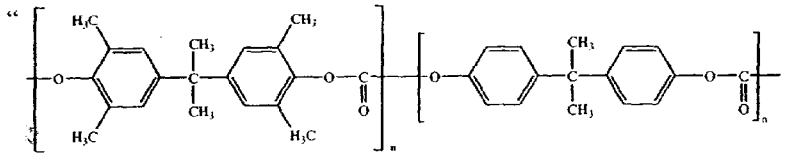

"

should read:

(1-4)

--

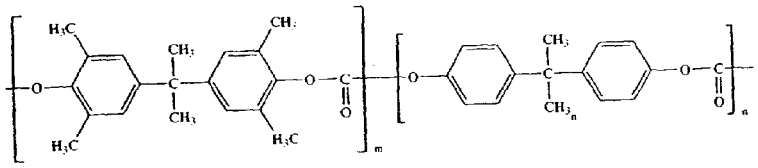

--

Signed and Sealed this

Twenty-second Day of July, 2003

JAMES E. ROGAN
*Director of the United States Patent and Trademark Office*